US011472522B2

(12) United States Patent
Smith

(10) Patent No.: US 11,472,522 B2
(45) Date of Patent: Oct. 18, 2022

(54) HORIZONTAL RESCUE SYSTEM

(71) Applicant: Shane Michael Smith, Greenbrae, CA (US)

(72) Inventor: Shane Michael Smith, Greenbrae, CA (US)

(73) Assignee: C-HERO, LLC, Greenbrae, CA (US)

( * ) Notice: Subject to any disclaimer, the term of this patent is extended or adjusted under 35 U.S.C. 154(b) by 104 days.

(21) Appl. No.: 17/131,362

(22) Filed: Dec. 22, 2020

(65) Prior Publication Data

US 2021/0107609 A1 Apr. 15, 2021

Related U.S. Application Data

(63) Continuation-in-part of application No. 16/145,069, filed on Sep. 27, 2018.

(60) Provisional application No. 62/564,156, filed on Sep. 27, 2017.

(51) Int. Cl.
*B63C 9/11* (2006.01)

(52) U.S. Cl.
CPC ..... *B63C 9/11* (2013.01)

(58) Field of Classification Search
CPC .... B63C 9/00; B63C 9/01; B63C 9/02; B63C 9/08; B63C 9/11
See application file for complete search history.

(56) References Cited

U.S. PATENT DOCUMENTS 1,268,303 A * 6/1918 Wanat ..... B63B 32/20 441/65
2,088,251 A * 7/1937 Walters ..... B63C 9/08 441/85
2011/0220695 A1* 9/2011 Saunders ..... A61G 1/044 441/80
2021/0253400 A1* 8/2021 Gaulin ..... B66C 1/18

* cited by examiner

*Primary Examiner* — Stephen P Avila

(74) *Attorney, Agent, or Firm* — Steven A. Nielsen; www.NielsenPatents.com

(57) ABSTRACT

A man overboard system may comprise a strap system allowing for the rescue of a subject who is in a horizontal position. A strap system may comprise a loop 830 with an end of the loop defining a chest strap securing the chest of a victim and a one-way buckle 840 retaining the chest strap around the victim. A side of the chest strap may be attached to a main body strap 870 which may comprise a plurality of webbing tubing pieces 880 or a monolithic sheet of material to support the backside of the victim. An attachment bar 885 may be attached to the main body strap and a plurality of side straps 860. The side straps may be attached to a far end of the loop.

7 Claims, 19 Drawing Sheets

HORIZONTAL RESCUE SYSTEM

CROSS-REFERENCE TO RELATED APPLICATIONS

This utility application is a continuation in part (CIP) of patent application Ser. No. 16/145,069 filed on Sep. 27, 2018 which claims the benefit of provisional patent application 62/564,156 filed on Sep. 27, 2017. The present application claims the priority dates of the prior applications and incorporates herein by reference the contents of the prior applications as if restated herein.

COPYRIGHT AND TRADEMARK NOTICE

This application includes material which is subject or may be subject to copyright and/or trademark protection. The copyright and trademark owner(s) has no objection to the facsimile reproduction by any of the patent disclosure, as it appears in the Patent and Trademark Office files or records, but otherwise reserves all copyright and trademark rights whatsoever.

BACKGROUND OF THE INVENTION

(1) Field of the Invention

The invention generally relates to water rescue systems. More particularly, the invention relates to means and methods of horizontal restraint and capture system to lift a person out of the water.

(2) Description of the Related Art

The known related art fails to anticipate or disclose the principles of the present invention.

In the related art, general capture systems are known, but require excessive effort by a rescuer or lift a victim in a vertical position. The prior art lacks means or methods of creating an easy to use lift system that captures and contains a victim in a horizontal position. The disclosed embodiments are also effective for capturing a person who is treading water or otherwise in a more vertical position.

Thus, there is a need in the art for the presently disclosed embodiments.

BRIEF SUMMARY OF THE INVENTION

The present invention overcomes shortfalls in the related art by presenting an unobvious and unique combination and configuration of methods and components to quickly secure a webbing system upon a victim while the victim is in a horizontal position. Disclosed embodiments include means and methods of allowing a rescue operator to stay out of the water and to quickly capture of victim with a new strap system that deploys with ease around the victim. Once secured by a disclosed webbing or strap system, the victim may be raised from the water while maintaining a horizontal position.

The invention overcomes shortfalls in the related art by the creation and use of an integrated rescue pole, hoop and web packet arm that retains and then artfully deploys a new webbing or restraint system, the restraint system comprising a main chest strap, loop, one-way slide buckles, side straps, attachment bar, attachment bar hooks and main body straps.

Disclosed restraint systems may include the artful use of weights and stiffeners to obtain webbing shapes of optimal utility.

In general, disclosed embodiments may be quickly passed over a victim with the webbing deploying in reaction to the natural passage of the victim through the disclosed hoop system. A specially mounted and packed web packet retains webbing components that are released when a victim passes through the hoop system.

These and other objects and advantages will be made apparent when considering the following detailed specification when taken in conjunction with the drawings.

REFERENCE NUMERALS IN THE DRAWINGS

Figure 1:
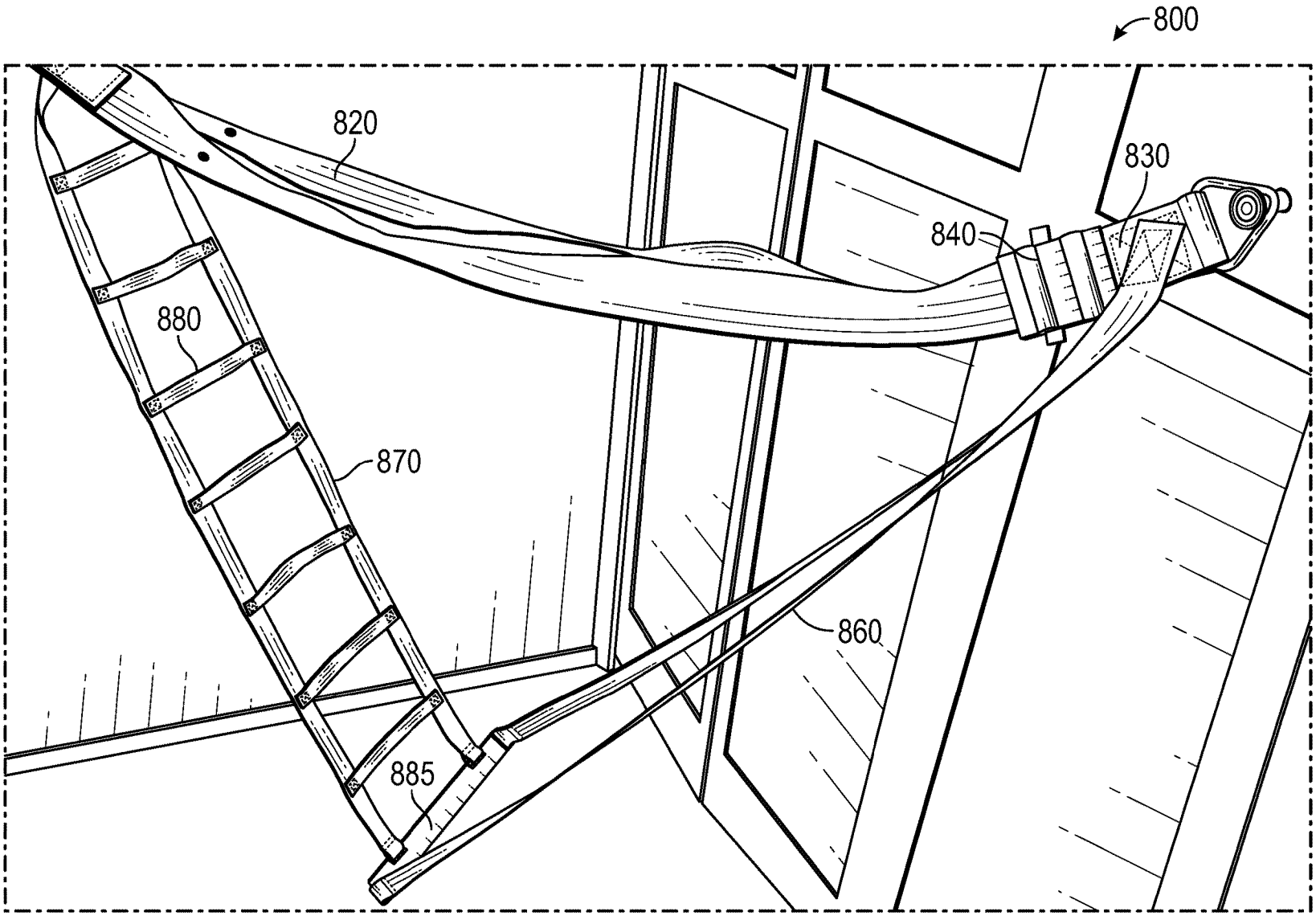
FIG. 1 depicts a perspective view of strap components

500 lower pole assembly
510 reach frame
515 pole adapter
517 distal reach frame member
520 frame bar
522 distal storage void, defined between distal reach frame member 517 and frame bar 520
540 strap
545 strap holder
550 buckle
555 buckle holder
560 strap to rope connector
600 upper pole assembly
610 pole
620 V cleat

630 wire pin

800 a disclosed restraint or capture embodiment in general

820 main chest strap

830 loop

840 one way slide buckle

860 side strap

870 main body strap

880 lateral tubing or monolithic material with webbing and optional weights

885 attachment bar

887 hooks of attachment bar 885

950 test subject, person being rescued or test dummy

DETAILED DESCRIPTION OF EMBODIMENTS OF THE INVENTION

The following detailed description is directed to certain specific embodiments of the invention. However, the invention can be embodied in a multitude of different ways as defined and covered by the claims and their equivalents. In this description, reference is made to the drawings wherein like parts are designated with like numerals throughout.

Unless otherwise noted in this specification or in the claims, all of the terms used in the specification and the claims will have the meanings normally ascribed to these terms by workers in the art.

Unless the context clearly requires otherwise, throughout the description and the claims, the words "comprise," "comprising" and the like are to be construed in an inclusive sense as opposed to an exclusive or exhaustive sense; that is to say, in a sense of "including, but not limited to." Words using the singular or plural number also include the plural or singular number, respectively. Additionally, the words "herein," "above," "below," and words of similar import, when used in this application, shall refer to this application as a whole and not to any particular portions of this application.

The above detailed description of embodiments of the invention is not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize. For example, while steps are presented in a given order, alternative embodiments may perform routines having steps in a different order. The teachings of the invention provided herein can be applied to other systems, not only the systems described herein. The various embodiments described herein can be combined to provide further embodiments. These and other changes can be made to the invention in light of the detailed description.

Any and all the above references and U.S. patents and applications are incorporated herein by reference. Aspects of the invention can be modified, if necessary, to employ the systems, functions and concepts of the various patents and applications described above to provide yet further embodiments of the invention.

FIG. 1 depicts a disclosed embodiment 800 which may include various strap components which may include a loop 830, main chest strap 820, one-way slide buckle 840 and main body strap 870. The main body strap may include a plurality of lateral tubing 880 pieces with optional weights. One or more side straps 860 may be attached to the main body strap and/or loop 830. The loop 830 may be considered to be distal or away from the person being rescued. The slide buckle 840 may be pulled or otherwise urged toward the person. The position of the slide buckle may define the lengths of the loop 830 and main chest strap 830. As the slide buckle is slide towards the person, the length of the chest strap will shorten while the length of the loop will increase. The chest strap may be considered near or proximal to the person being rescued.

Figure 2:
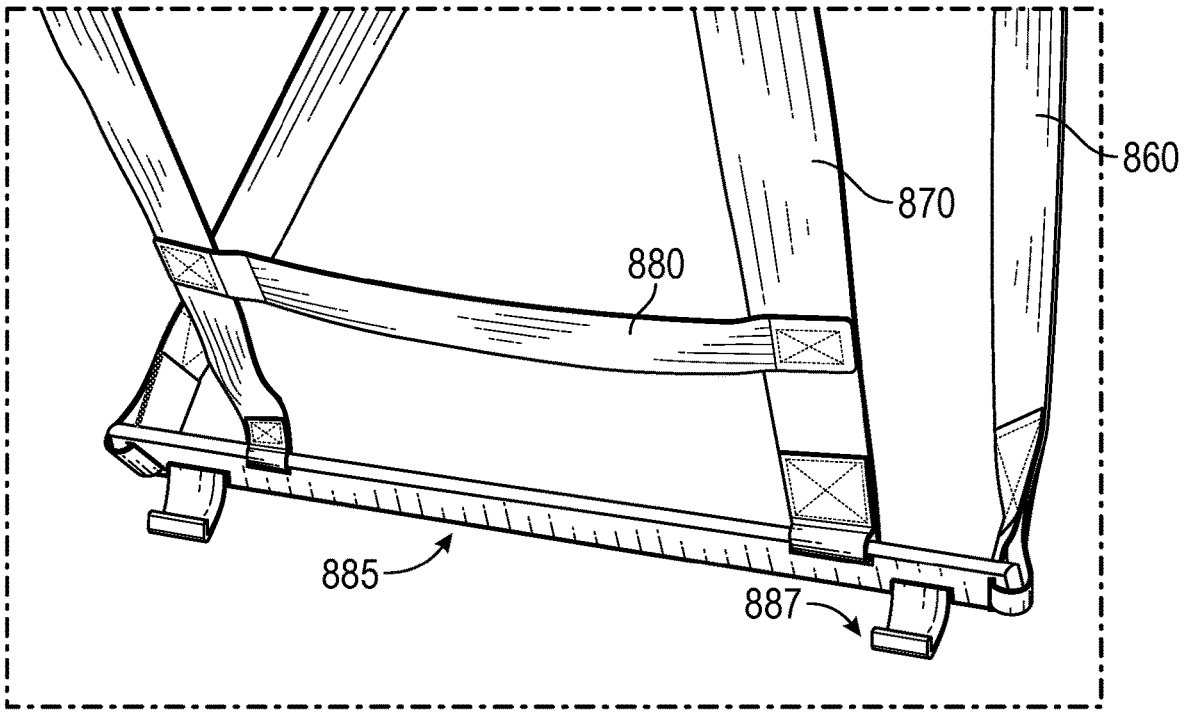
FIG. 2 depicts a perspective view of an attachment bar and hooks of the attachment bar

FIG. 2 depicts an attachment bar 885 and hooks 887 of the attachment bar. The attachment bar 885 may be attached to the main body strap 870 and/or one or more side straps 860.

Figure 3:
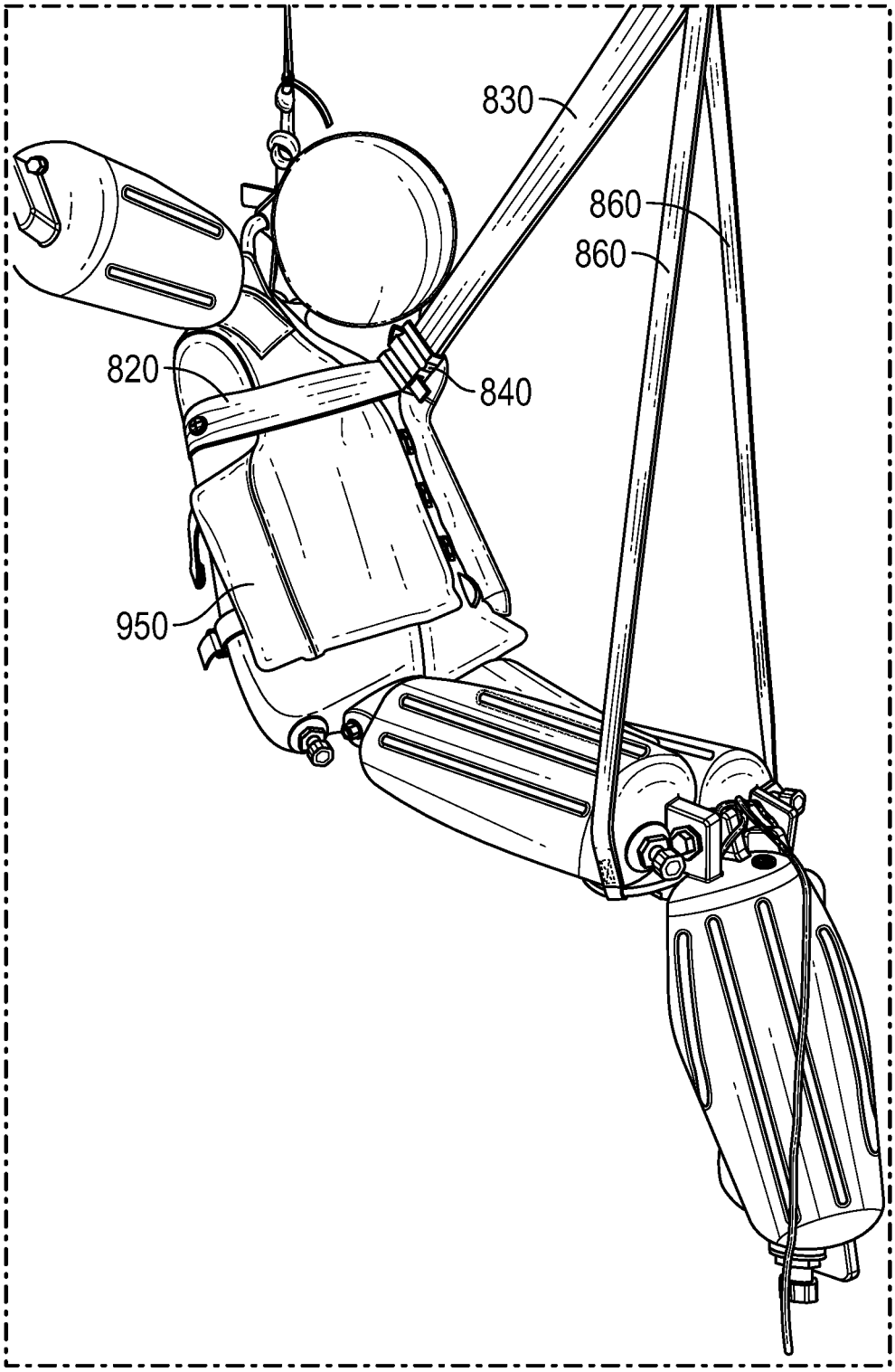
FIG. 3 depicts a perspective view of disclosed components is use

FIG. 3 depicts a test subject or rescue dummy 950 secured by a disclosed embodiment which may include a one-way slide buckle 840 containing a loop 830 and chest strap 820 portion. A pair or set of side straps 860 may secure or support the lower body or lower sections of a victim or rescue dummy.

Figure 4:
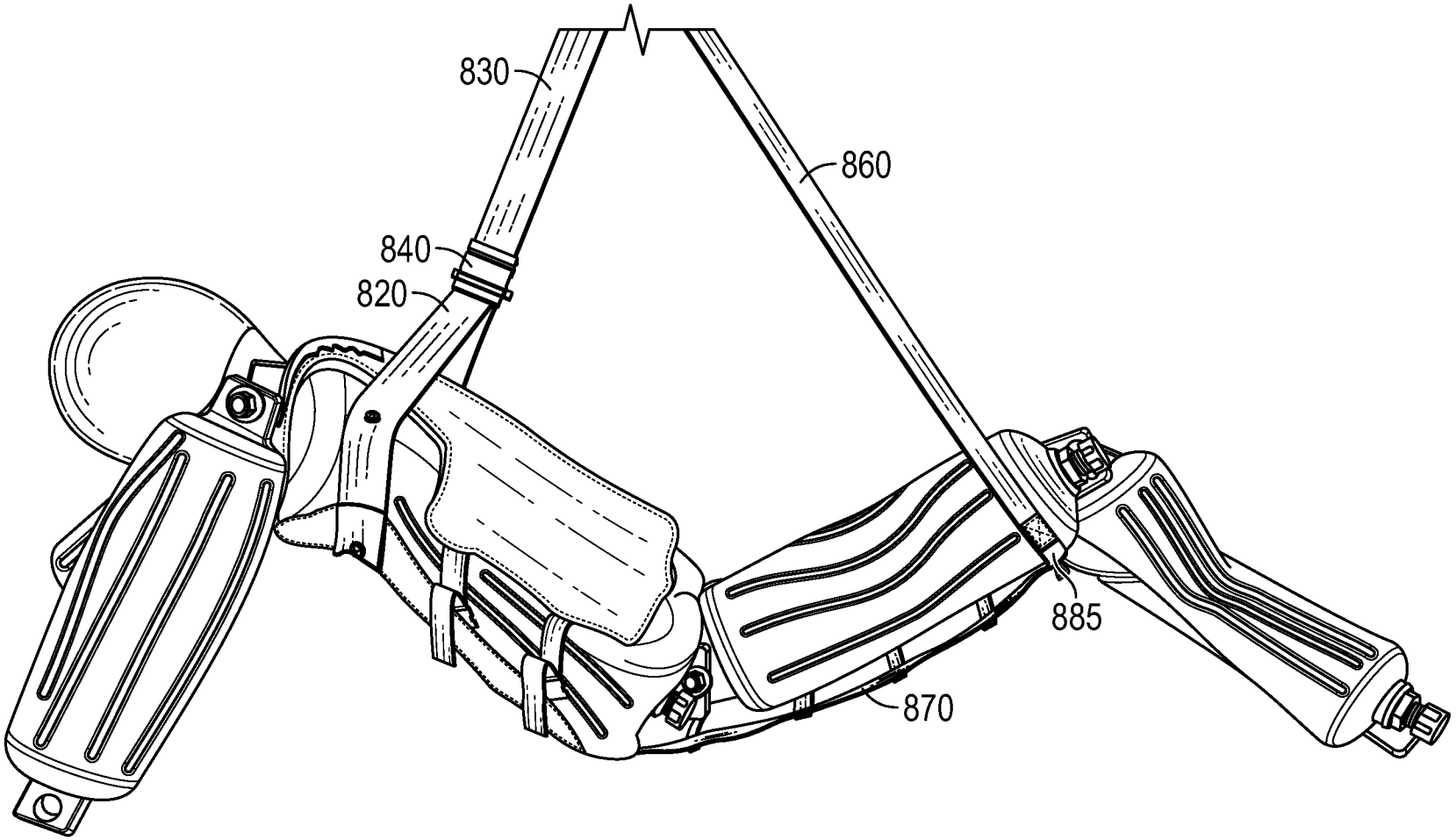
FIG. 4 depicts a perspective view of disclosed components in use

FIG. 4 depicts a test subject or rescue dummy secured by a disclosed embodiment. A rescue dummy is being hoisted by use of disclosed components which may include a loop 830, one-way slide buckle 840 and chest strap 820 with the chest strap 820 attached to a main body strap 870 and the main body strap attached to an attachment bar 885 with the attachment bar 885 attached to one or more side straps 860.

Figure 5:
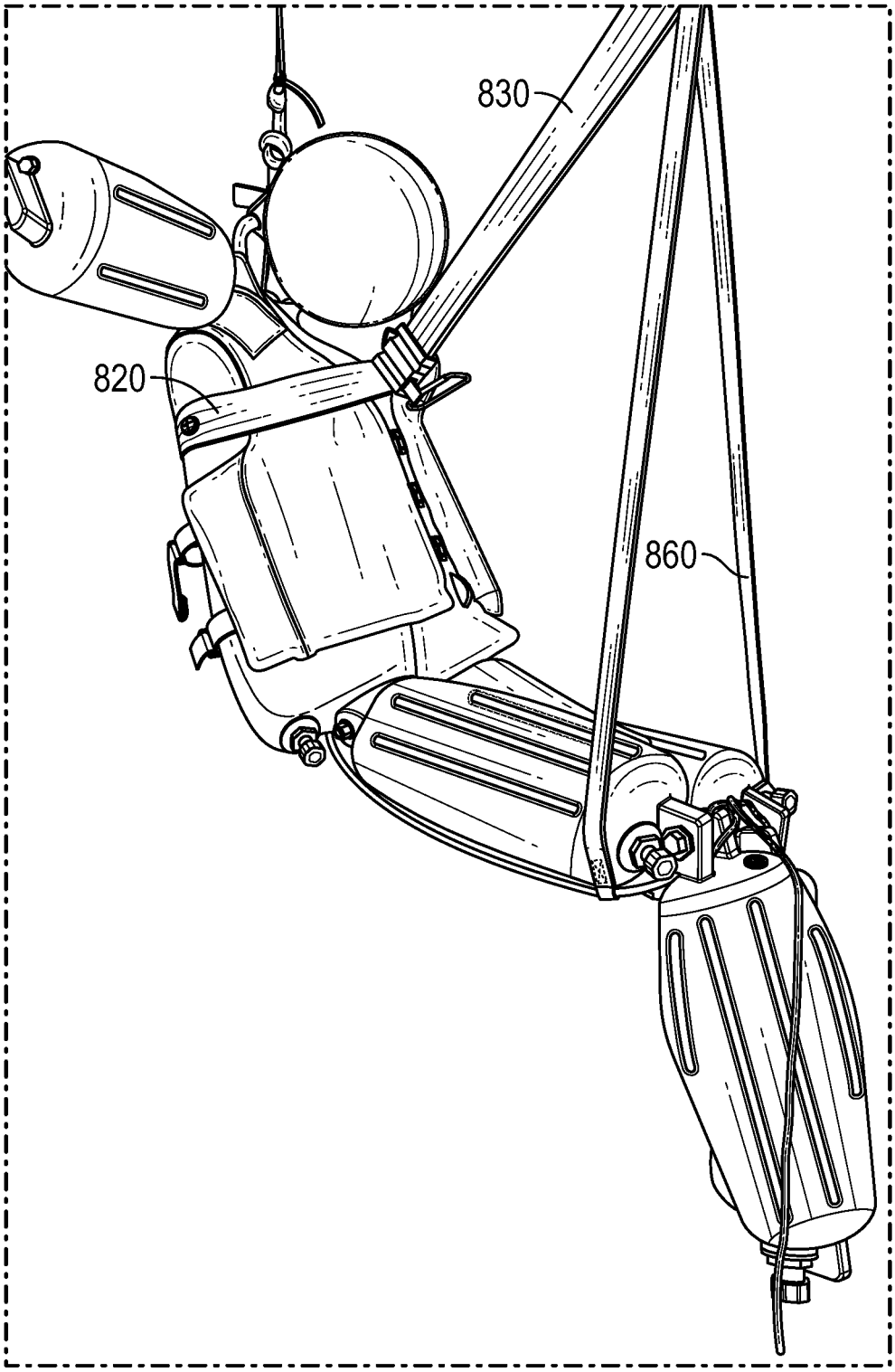
FIG. 5 depicts a perspective view of disclosed components in use

FIG. 5 depicts a test subject or rescue dummy secured by a disclosed embodiment and may be conserved a side view of FIG. 4.

Figure 6:
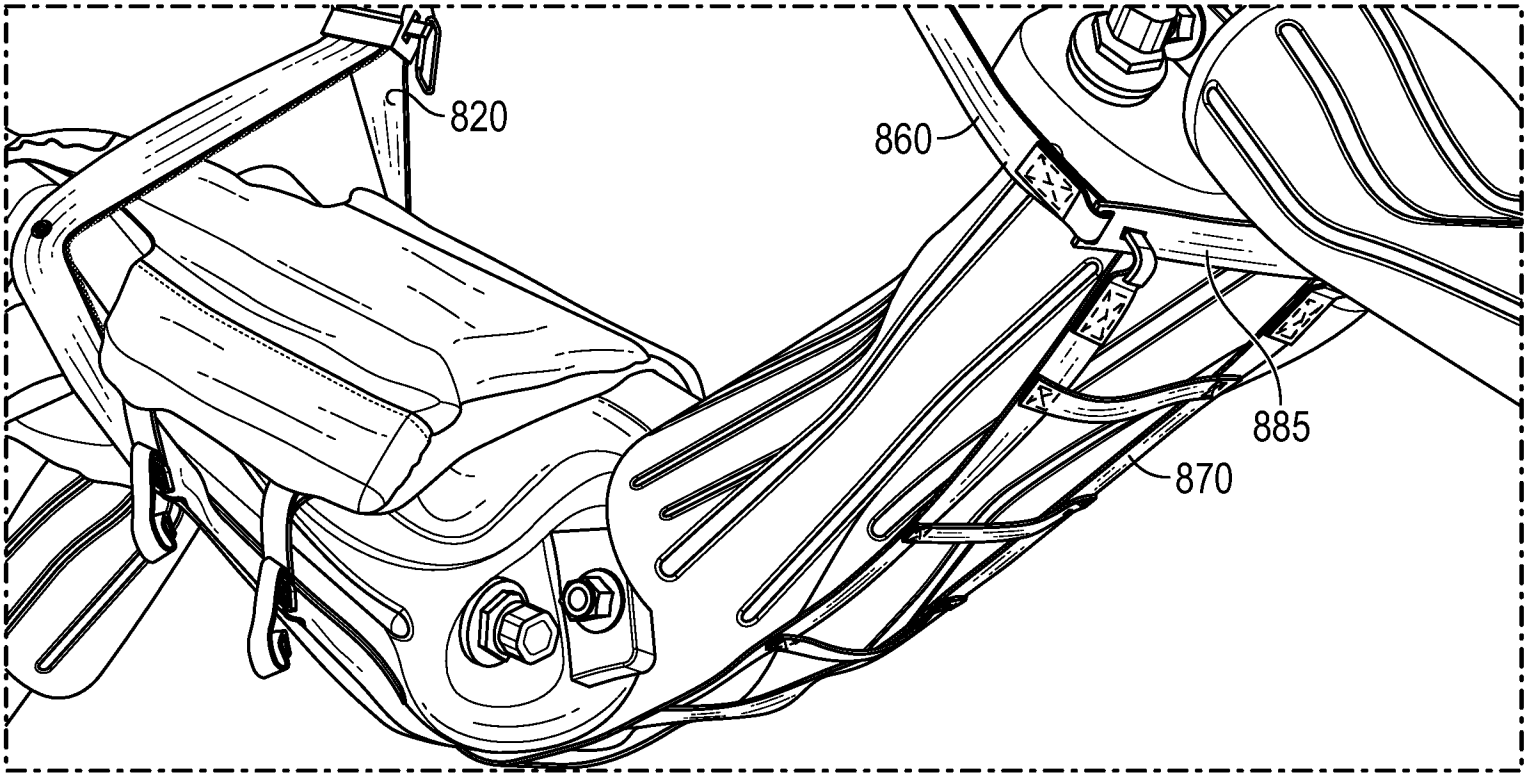
FIG. 6 depicts a perspective view of disclosed components in use

FIG. 6 depicts back ladder webbing supporting a rescue dummy secured by a disclosed embodiment.

Figure 7:
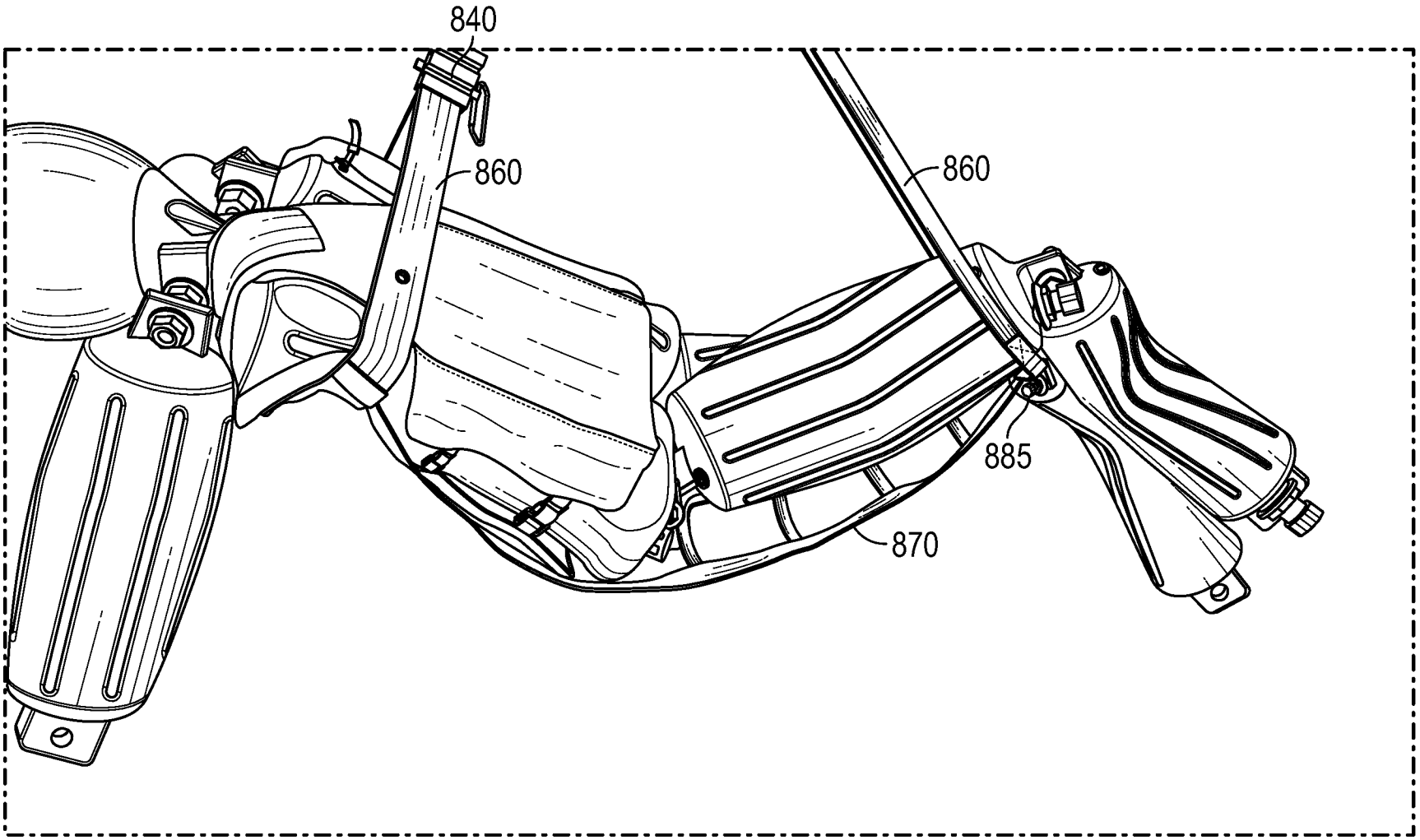
FIG. 7 depicts a perspective view of disclosed components in use

FIG. 7 depicts a test subject or rescue dummy secured by a disclosed embodiment.

Figure 8:
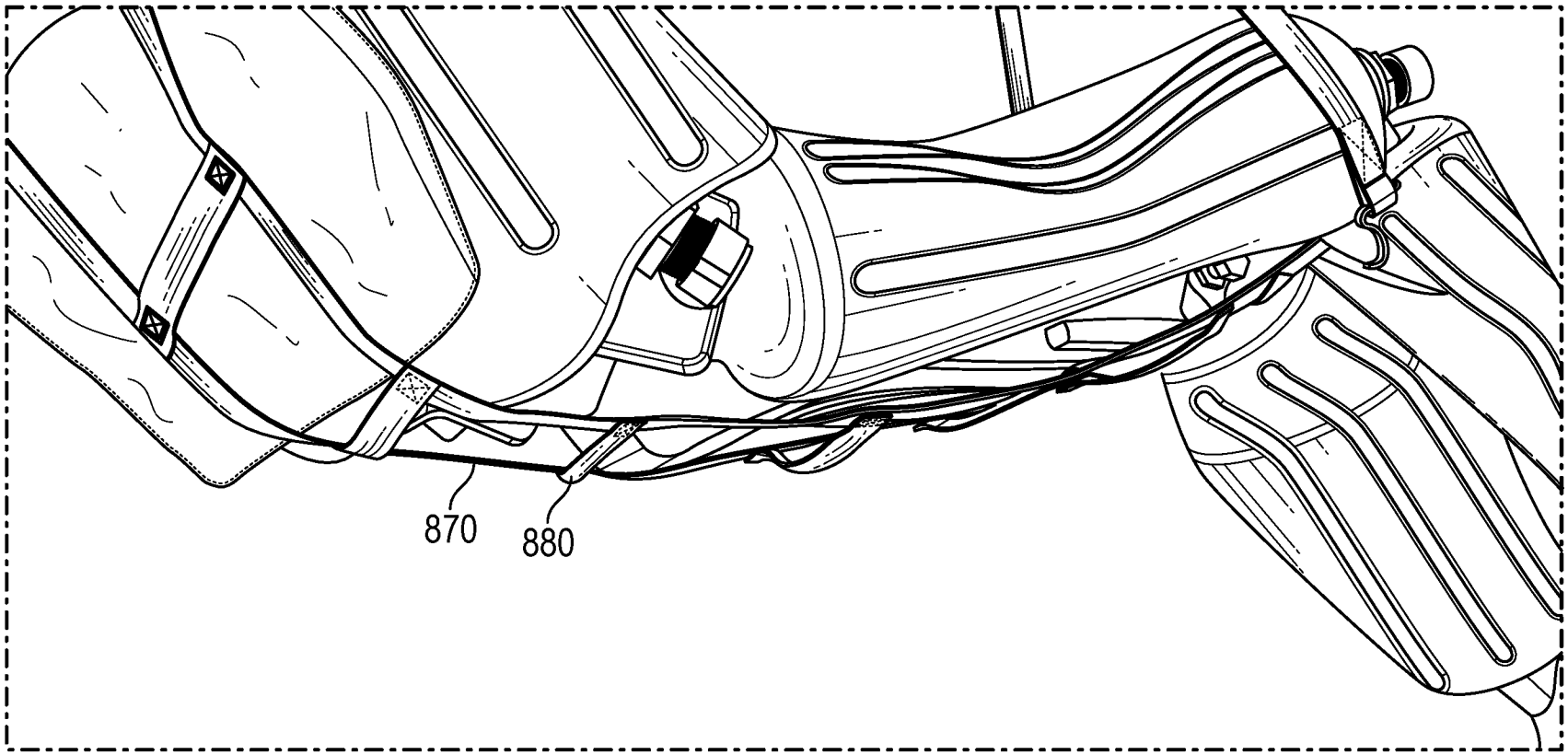
FIG. 8 depicts a lower perspective view of disclosed components in use

FIG. 8 depicts a test subject or rescue dummy secured by a disclosed embodiment.

Figure 9:
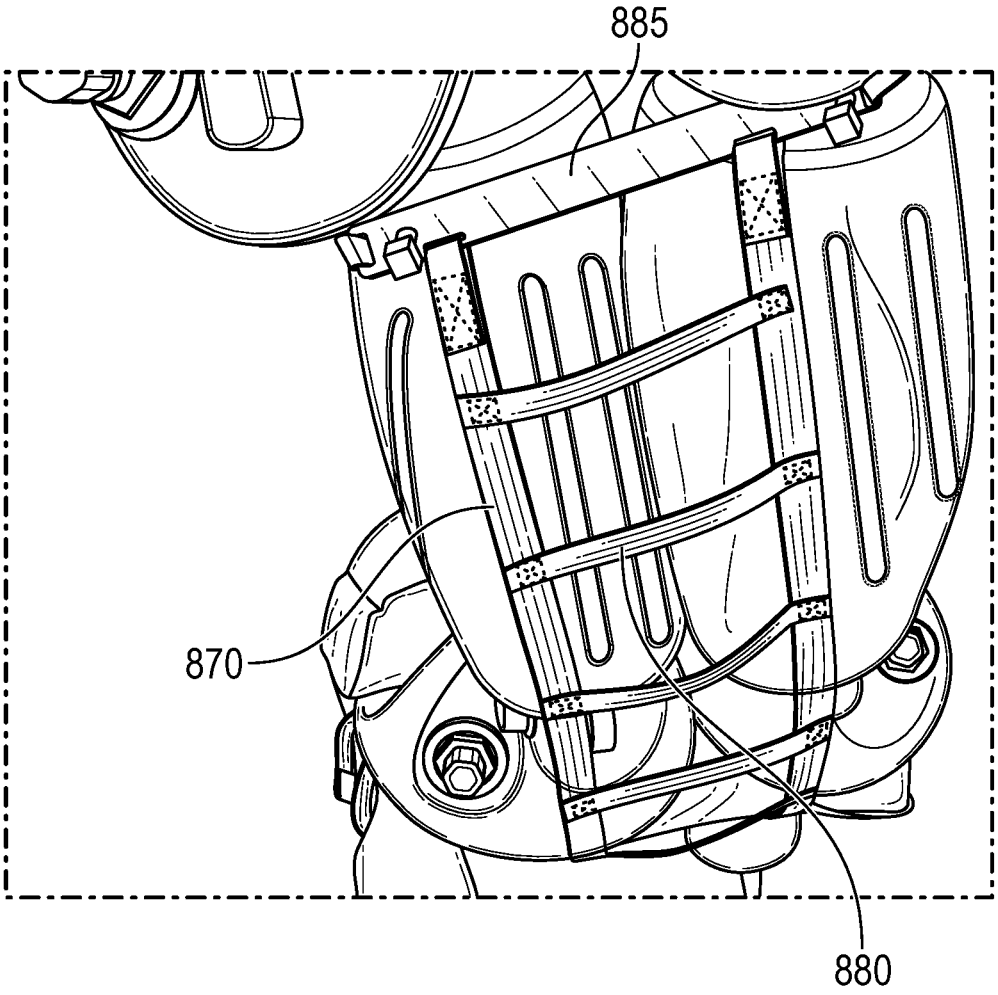
FIG. 9 depicts a lower perspective view of disclosed components in use

FIG. 9 depicts back ladder webbing or a pair of main body straps 880 connected to a plurality of lateral tubbing pieces 880.

Figure 10:
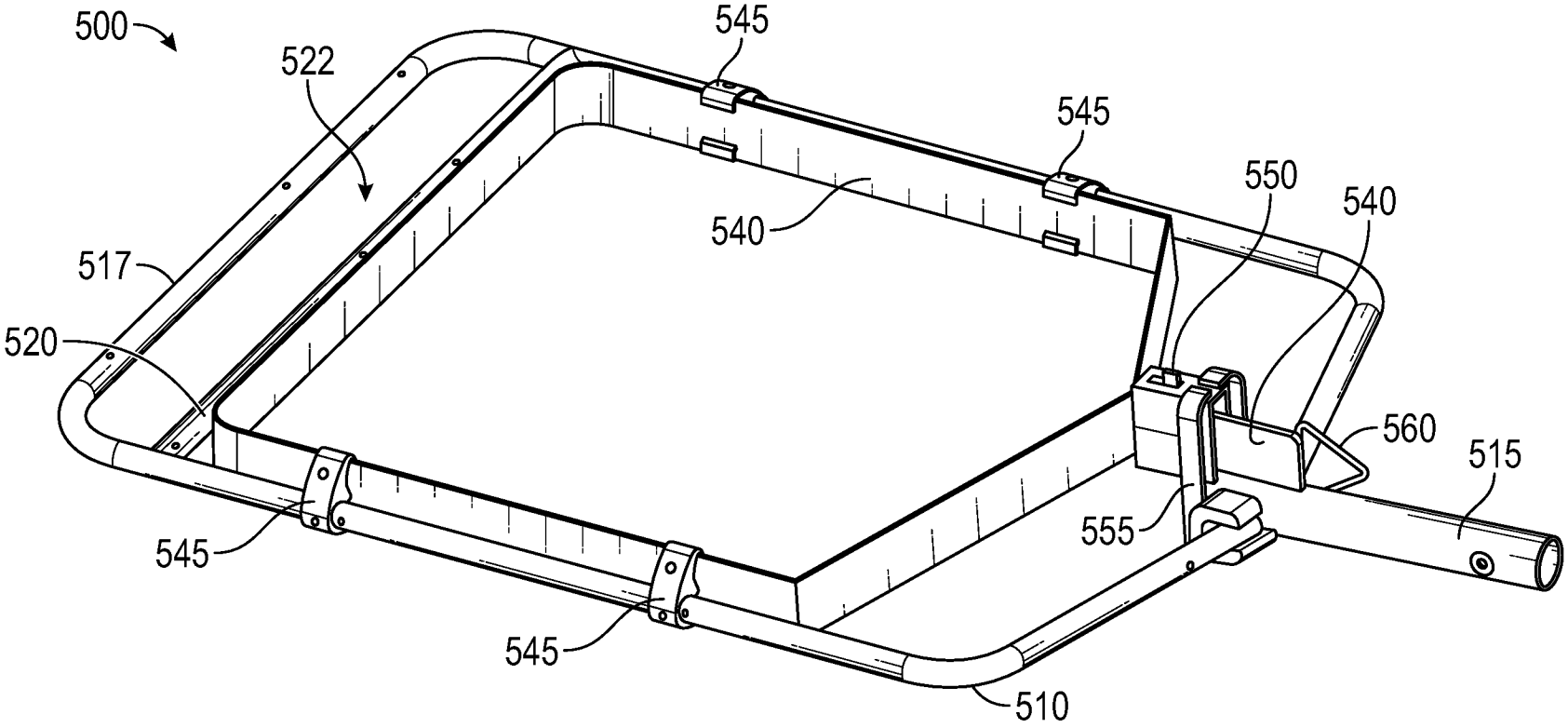
FIG. 10 depicts a lower pole system with strap components attached.

FIG. 10 depicts a lower pole assembly 500 that may be used to deploy a disclosed strap system and may include a reach frame 510 defining a center void the center void used to a swimmer or person to be rescued.

Figure 11:
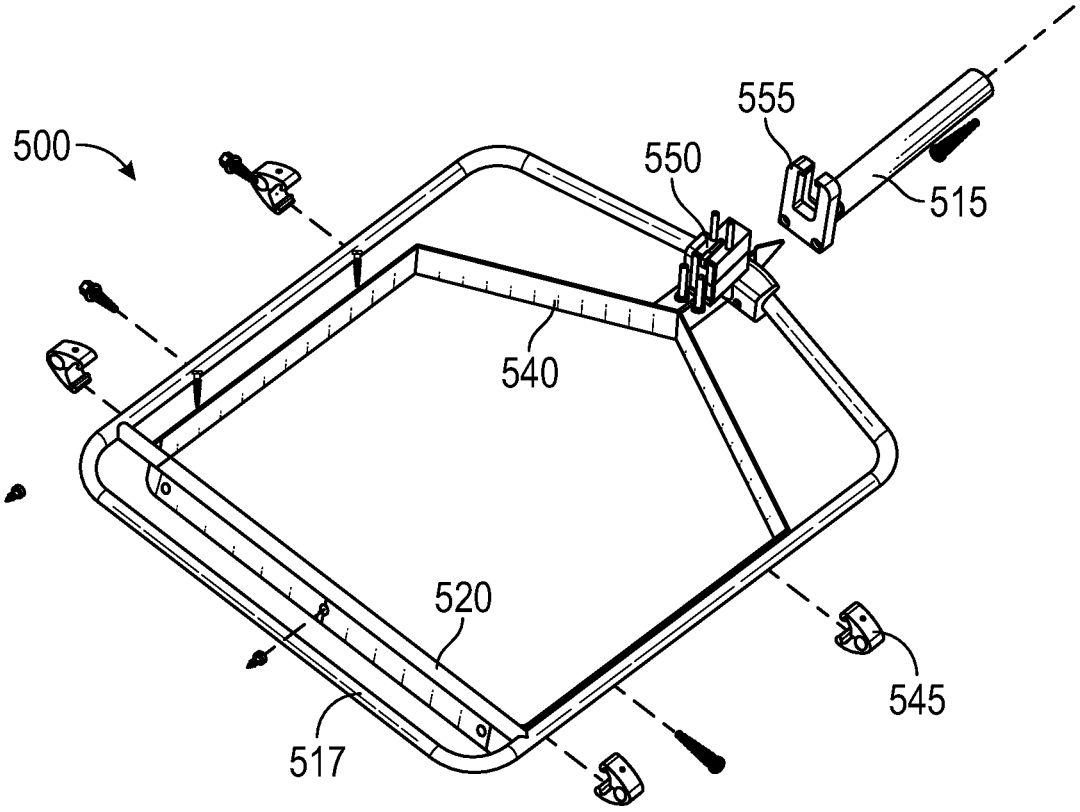
FIG. 11 depicts an exploded view of a lower pole system

FIG. 11 depicts an exploded view of a lower pole assembly 500, which may comprise a reach frame 515, a buckle holder 555, a buckle 550 or slide buckle 840, a frame strap 540 which may take the form of a main chest strap 820, with the frame strap or main chest strap secured to the lower pole assembly by use of one or more strap holders 545. The strap holders may be considered releasable holders as the strap holders define a center void which allows the chest strap to break free as the chest strap tightens around the person. As the strap to rope connector 560 is pulled by the rescue person, the buckle holder 555 retains the buckle 550 or one-way slide buckle 840 causing the length of the chest strap to shorten, causing the chest strap to press through the voids defined by the strap holders 545.

Figure 12:
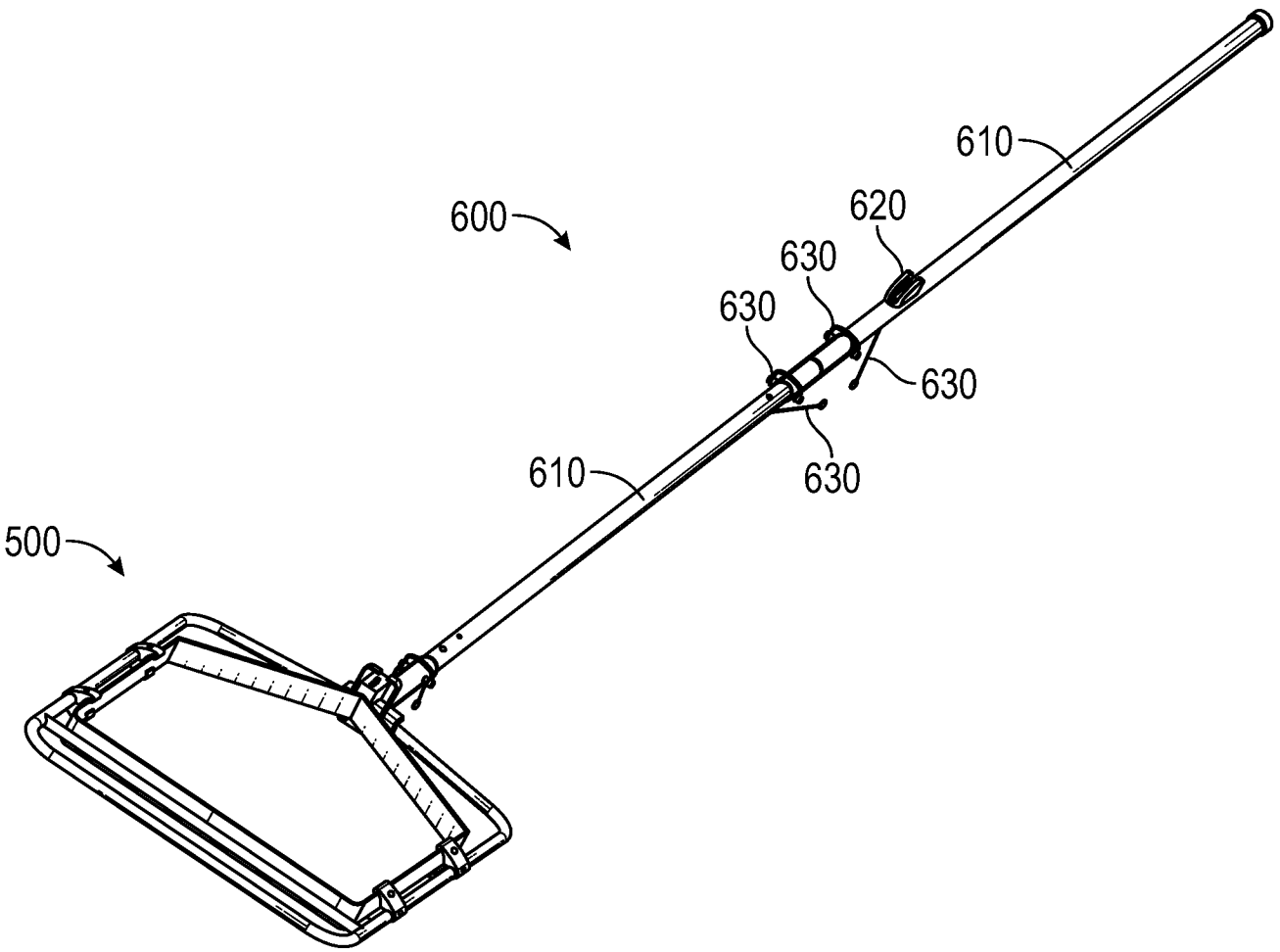
FIG. 12 depicts a lower pole attached to an upper pole

FIG. 12 depicts an upper and lower pole assembly. An upper pole assembly may comprise a pole 610, a V cleat 620, a wire pin 630.

Figure 13:
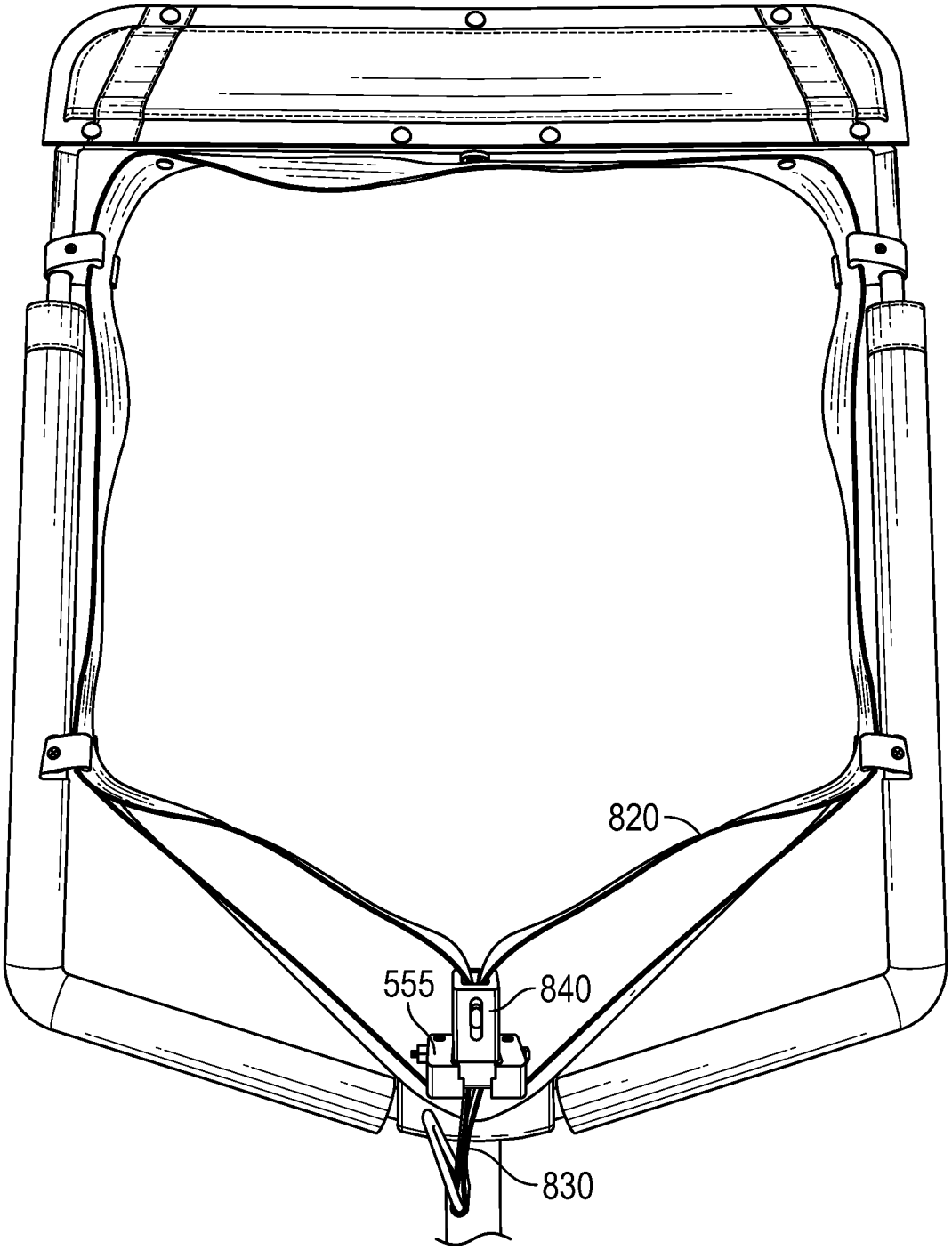
FIG. 13 depicts a fully loaded hoop

FIG. 13 depicts an embodiment comprising a loop 830 or main chest strap secured by a lower pole assembly, a one-way slide buckle 840 containing a loop. The one-way slide buckle may be scoured to the frame by use of a buckle holder 555.

Figure 14:
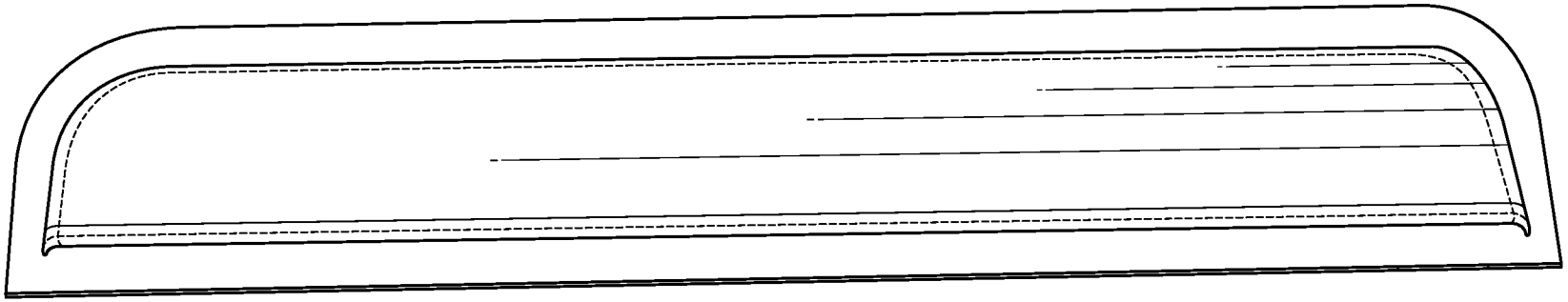
FIG. 14 depicts a top cover

FIG. 14 depicts a top cover. The top cover may contain disclosed components.

Figure 15:
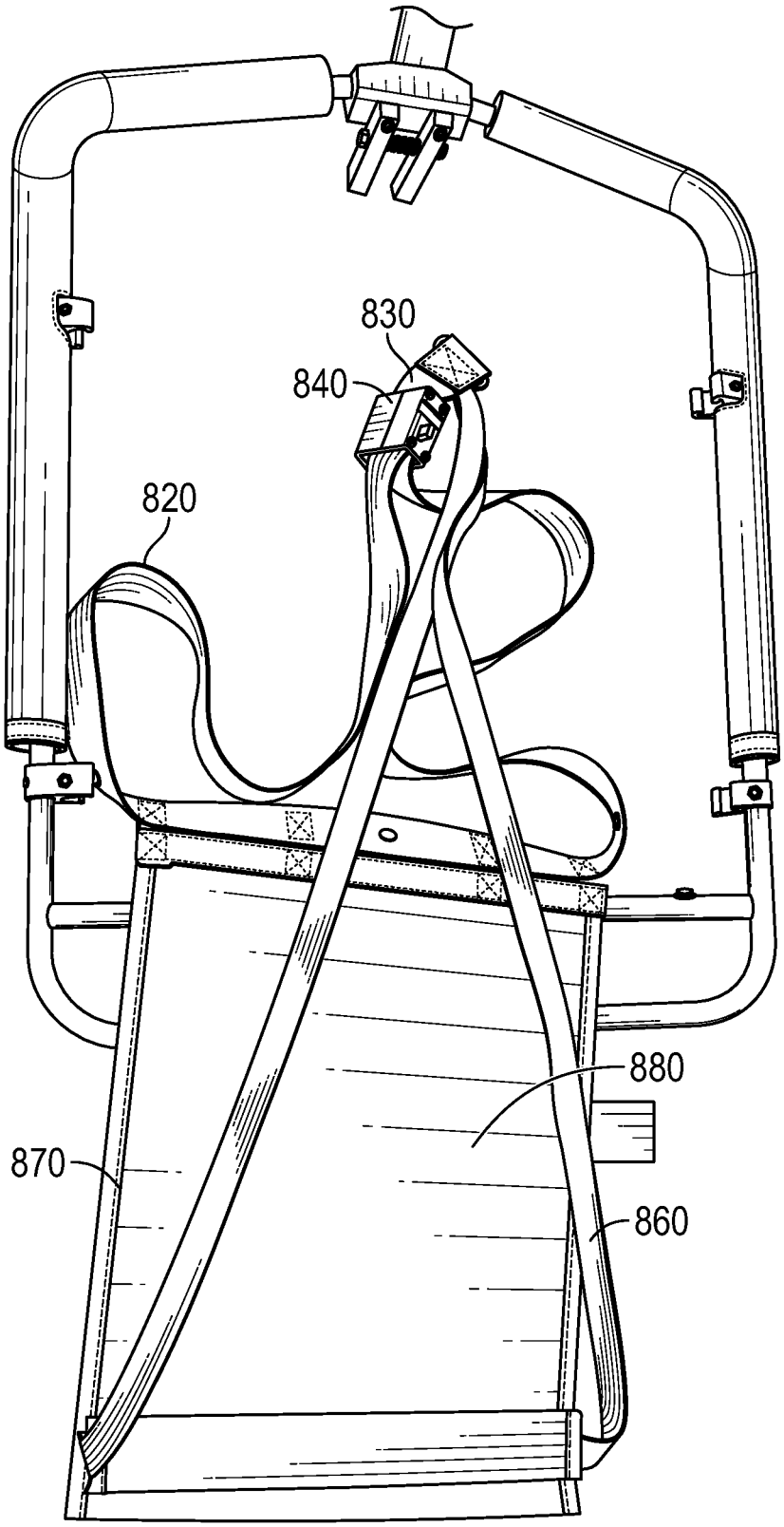
FIG. 15 a hoop being loaded with a sling

FIG. 15 depicts a strap system released from a frame. A main body strap 870 may include a plurality of lateral tubing pieces or a monolithic material 880.

Figure 16:
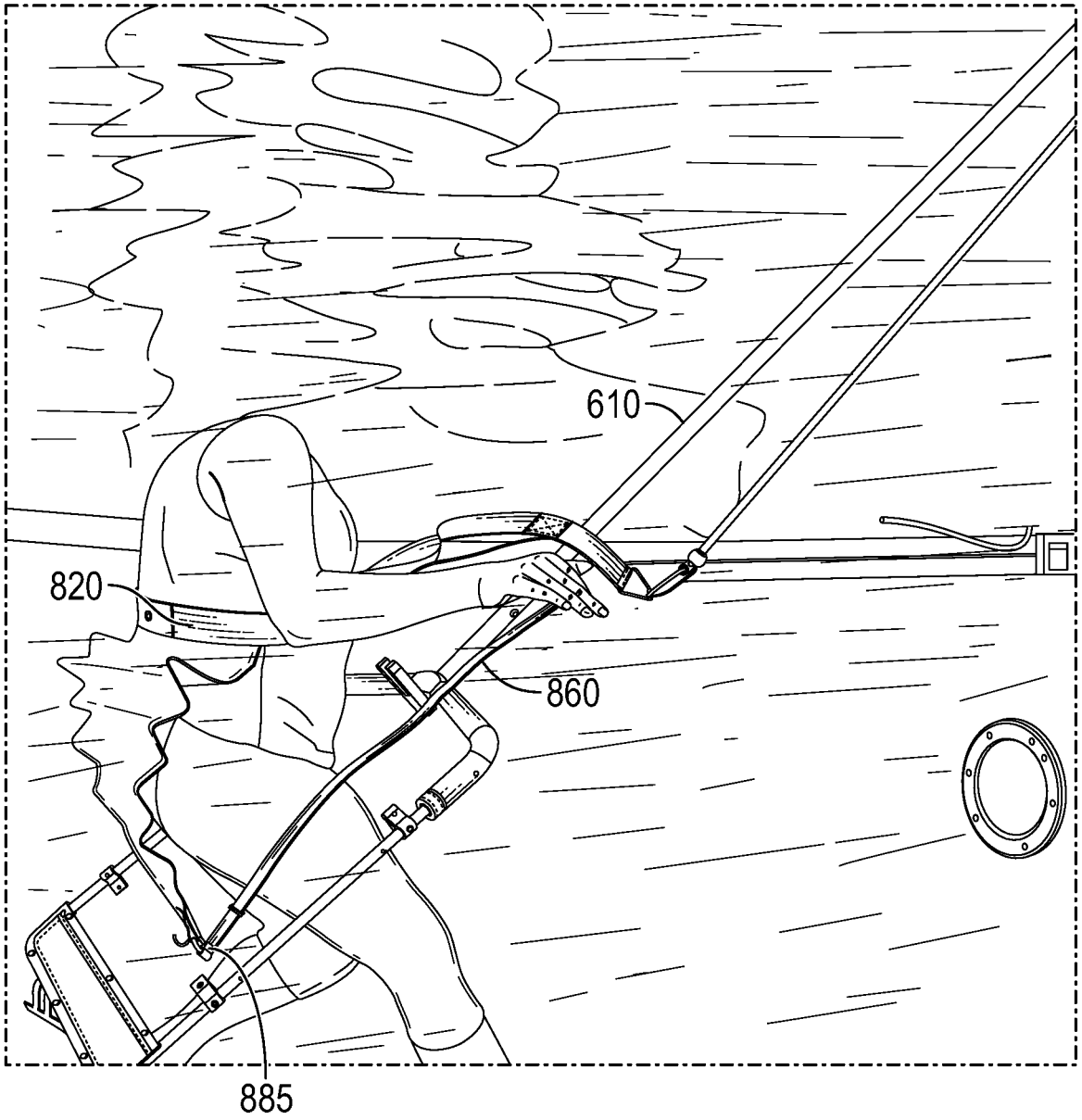
FIG. 16 depicts a person and disclosed embodiment deployed under water.

FIG. 16 depicts disclosed components used in a submerged setting.

Figure 17:
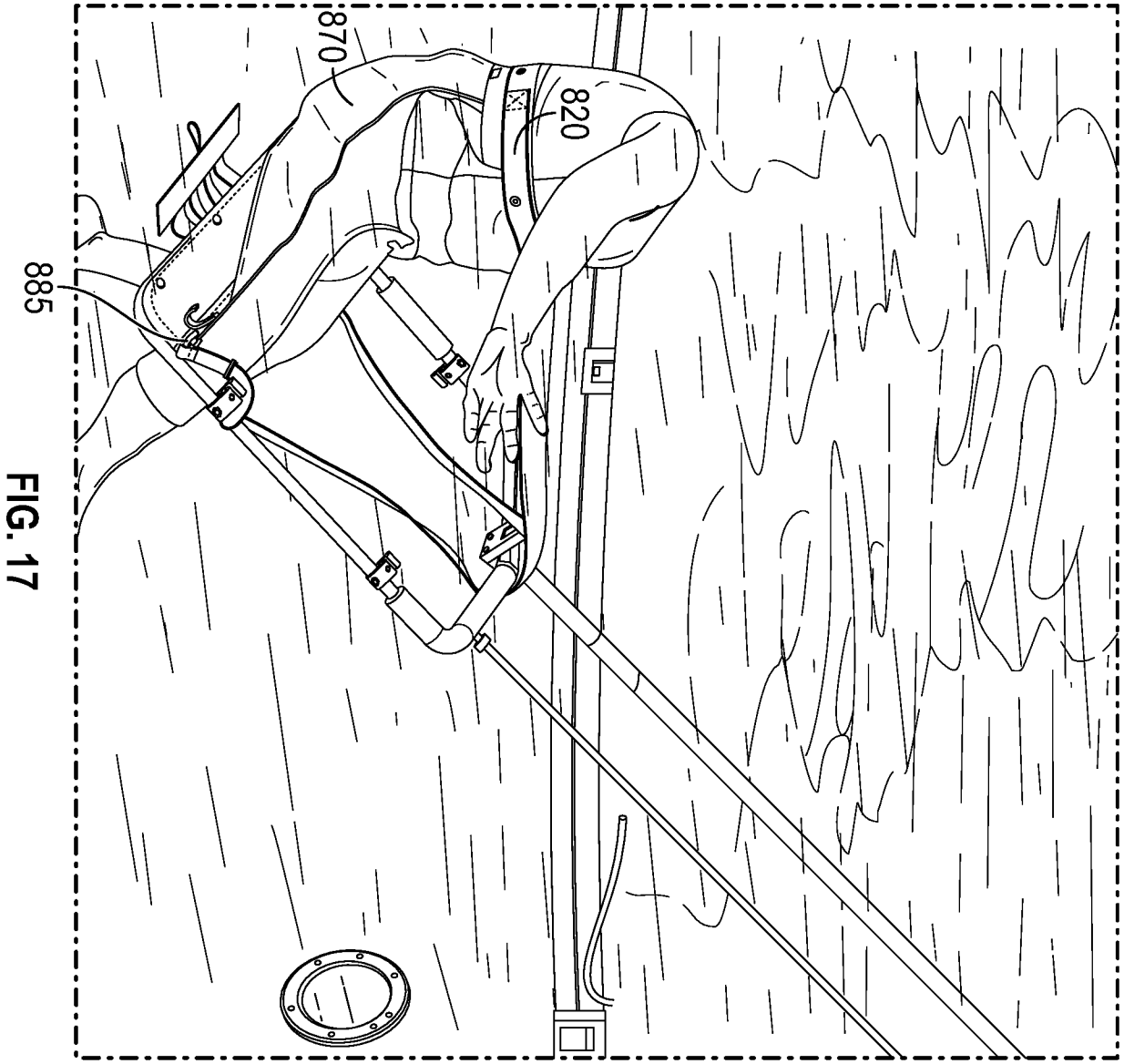
FIG. 17 depicts a person and disclosed embodiment deployed under water.

FIG. 17 depicts disclosed components used in a submerged setting.

Figure 18:
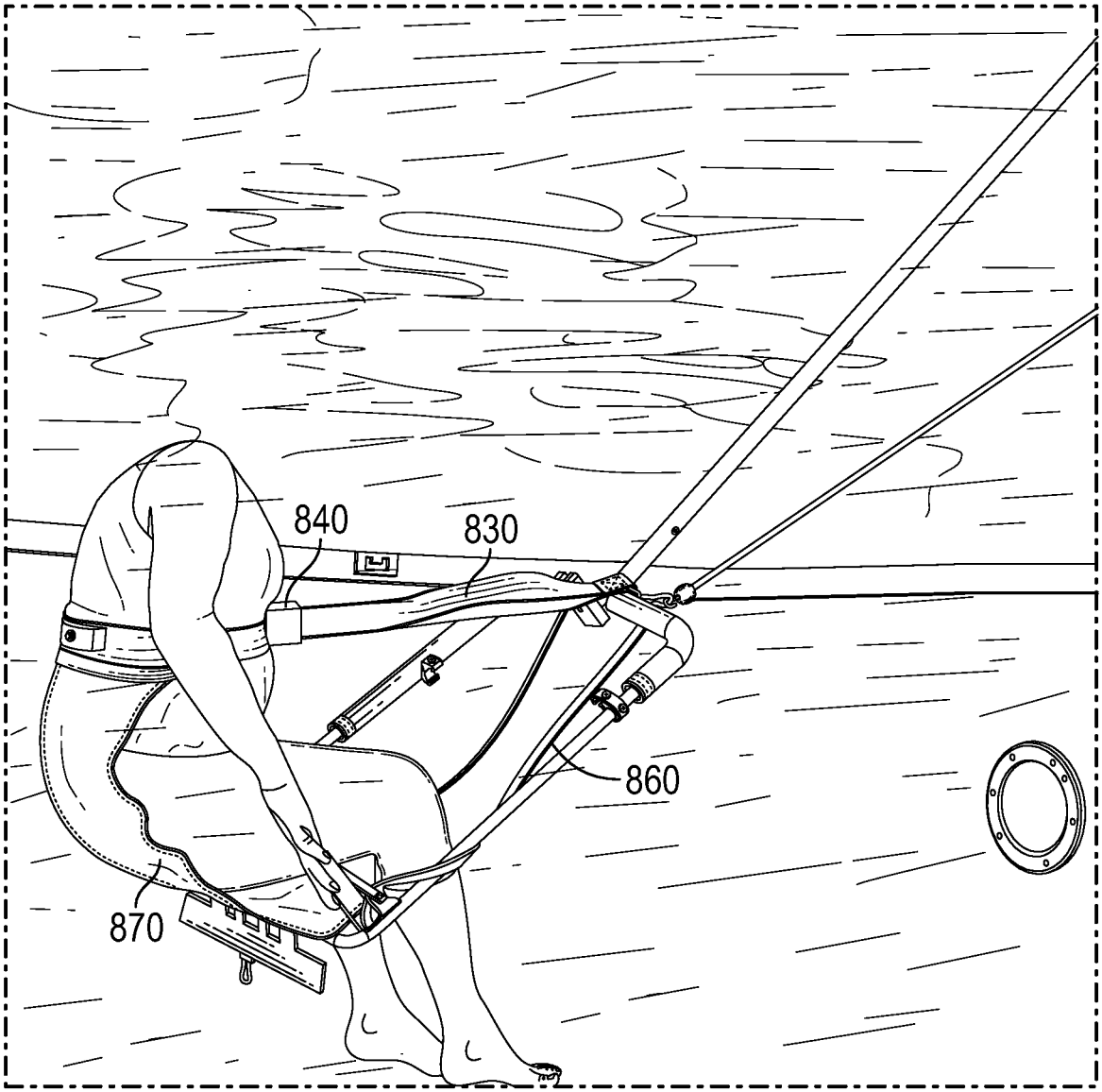
FIG. 18 depicts a person and disclosed embodiment deployed under water.

FIG. 18 depicts disclosed components used in a submerged setting.

Figure 19:
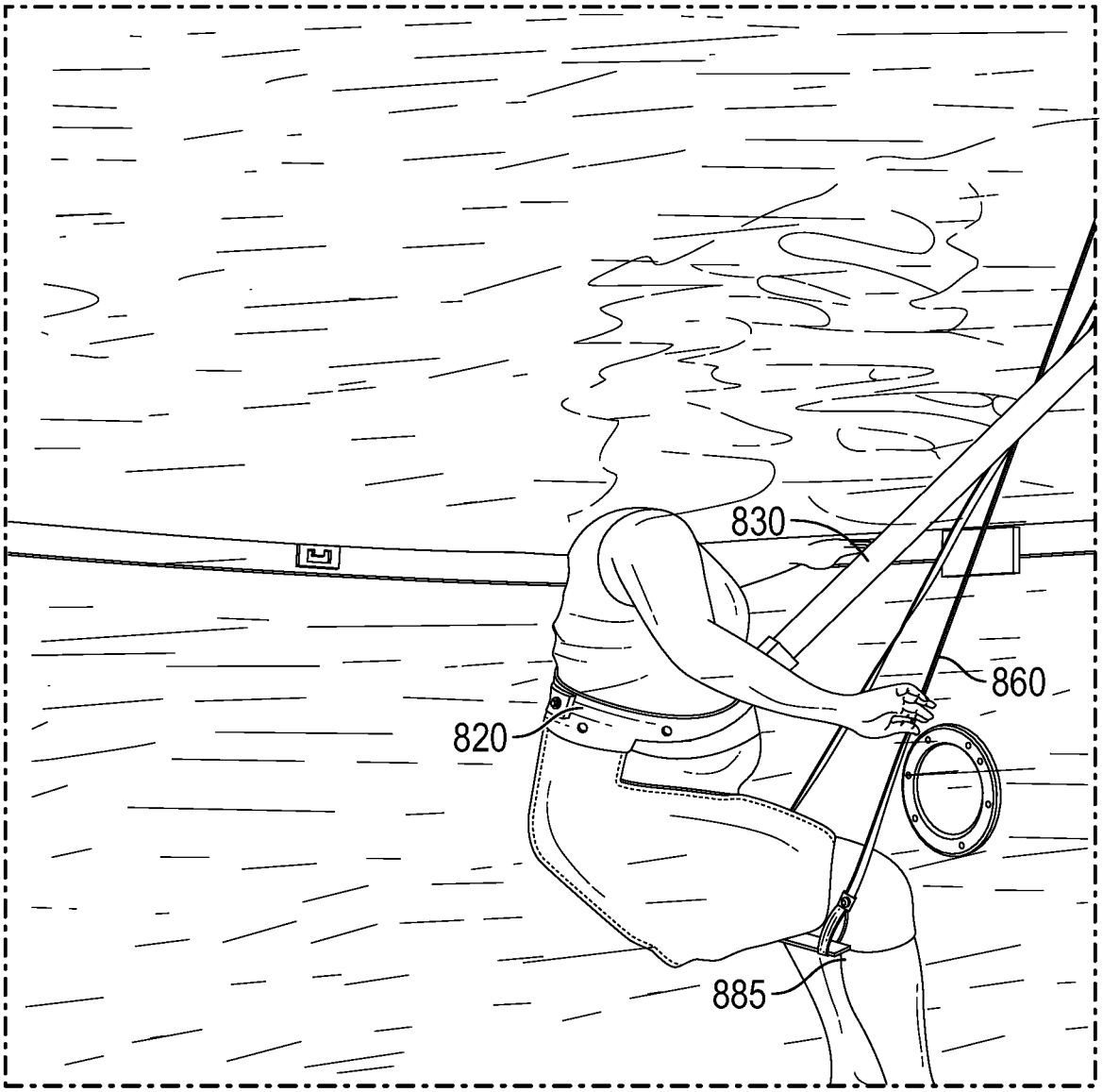
FIG. 19 depicts a person and disclosed embodiment deployed under water.

FIG. 19 depicts disclosed components used in a submerged setting.

The disclosed components are not limited to any particular material.

An initial set up or assembly of a disclosed embodiment may comprise the following steps Disclosed embodiments may comprise two poles, a hoop sometimes made of aluminum, a lifting strap sometimes comprising a side buckle and a buckle holder. In an initial installation the following steps may occur:

1. Align the countersink holes in the buckle holder to the threaded holes on the hoop block. Fasten the two provided cap screws using an Allen wrench.

Adjustment Note: The slide buckle holding tension can be adjusted with side nuts, and the enclosed LOCTITE®.

2. Lay the poles and hoop out. Lay the flat side of the hoop down, buckle holder up.

a. The pole with the aluminum coupler fits into the hoop b. The other pole with the black "V" cleat fits into the first pole c. The "V" cleat should face up (the same direction as the buckle holder which is labeled with an up arrow).

3. Use the attached pins to secure the poles together.

Note: Optional stainless nut and bolt are included for permanent connection

4. The end of the pole has a hole for a lanyard.

Once assembled a disclosed embodiment may be further configured for horizontal rescue set up by use of the following steps or procedures:

Confirm that the Red Top cover is snapped on.

The hoop gets loaded from the bottom. Turn the hoop over so it's resting on the slide buckle holder, with the "UP" sticker facing down. Position yourself at the snap end, or opposite the slide buckle holder.

1. Pick up the Black sling from the center of the weighted end. The writing "FRONT" on the sling will be facing the end of the hoop, towards you. Move the slide buckle, all the way to the end by the lifting triangle. The slide buckle and holder should both have "UP" stickers facing down. Check to make sure there are no twists in any of the web straps.

2. Lay the sling flat over the end of the hoop, aligning both the center snap from the large Red lifting strap, and the hoop snap. "FRONT" on the sling will be facing up, and towards the hoop end, and you.

3. The RED sling release has 2 snaps on the ends, and the other, ends are sewn into the top cover. Move the RED release with snaps, to where the sling will load, so it's clear of the 2" lifting strap.

4. Snap the center snap of the 2" lifting strap to the hoop center snap.

5. Move the small Red webbing, coming from the weighted end, off to the side of the black sling. Fold the Black sling, starting from the 2" webbing that says "FRONT" and fold evenly in an accordion style (approx. 2" folds, to evenly fill the pocket neatly), and laying on the RED cover. The end of the weighted sling will end up on top of the folds, and should be laying flat and neatly in the hoop pocket.

6. Pull the RED sling release tight, over the folded sling, and fasten at the hoop end (coming from the top cover). Then fasten the two remainder snaps on the 2" Red lifting strap to the hoop.

7. Move the Slide Buckle towards the holder. Pull the small side web straps coming from the ends of the weighted sling, tight.

then place the small web strap, coming from the weighted end, behind the large web strap, that is snapped in on each side. The small web goes into the rubber blocks first then the 2" web holds it in, make sure it's not twisted, and slack pulled out as you go. Do the same at all blocks.

NOTE: The large and small web straps must be completely secured in the rubber blocks, and under the lip. Load all 4 rubber blocks the same.

8. Turn the hoop over, so the Slide Buckle holder is facing up, and then put the small side webbing around the slide buckle holder. Move the slide buckle as needed to fit in to the holder, (the Slide Buckle and Holder, must both have "UP" in the same direction).

Check to make sure that the large webbing is properly secured behind all of the rubber blocks.

In a horizontal rescue operation, the following steps may occur:

The lifting sling must be put on, with the slide buckle at the front of the person and the sling at their back!

1. Place the lift line in the "V" cleat, then maneuver the hoop over the body, so it's under the arms.

2. Hold the hoop against the back of the person, when in position take hold of the lift line from the "V" cleat, (make sure the slide buckle is in the center of the persons chest, and not off to the side), then push the pole to the person, pull back slightly to release from the buckle holder. The lift line should be held with a little tension, till the pole clears the body, (the pole needs to clear the body, by way of the feet, but not removed yet).

3. The pole hoop can be used to stretch out the sling/or move the body to the seated position if needed, all the while taking the slack out of the line. When the slack is out of the line, finish taking the pole off over the feet.

4. Use the winch to lift the person back aboard, and treat as per company protocol.

5. Rinse the equipment, and reload. Log the event and note any deficiencies.

A disclosed horizontal rescue sling may be constructed or may comprise:

2" Red webbing with lifting Triangle 100" total length with 2.5" overlap for Triangle and 1" webbing sewn in, at a 45 degree angle.

C-HERO private label sewn in at this spot

Release—2—1" pieces of RED webbing that are sewn into the top cover, with 2 snaps on the end 1" Red webbing for side straps 38" from the end of the weighted end to the beginning of the 2" webbing. This is a continuous loop and sewn into the 2" webbing where the Triangle is. The webbing gets sewn also to fabric and ends up being behind the weighted bar.

Weight—3/16"×1.5"×15", this gets sewn into the bottom of the fabric, (rolled up). The material is steel and needs to be 20 OZ. to be able to work properly.

Sling Material—Phifer Sheer Weave 4400 3% is what were using or an equivalent. 16" wide×28.75" long finished length, allow for the weight to be sewn in, with binding on the sides. The binding for the back of the phiser, when it lays over will be color coded to make it easier for instructions.

Top of the sling—(2) 1"×16" long pieces of Red web strap. One has "FRONT" and one has "BACK" embroidered on it in white, in the center of both.

Top of sling connections—(4) 1"×3" pieces of Red web strap to be sewn in on the back. The pieces go on the ends and in 3.5", then the "BACK" goes over it and the "FRONT" on the other side. These are not sewn 1" from the bottom, of the 2" webbing.

Front & Back—The front of the sling is the inside of the 2" webbing, or the smooth head of the snap, (Front—to the body, Back—back of sling).

Horizontal Top Cover

Marine grade UV resistant Sunbrella material. 4.5" wide× 26" long, cut to match the shape of the hoop, (curved ends). ½" thick of closed cell foam is sewn in, (to help with floatation). Embroidered on the top is, C-HERO RESCUE. a piece of reflective tape on each end is sewn in at an angle, (to help with visibility). 7 DOT durable female snaps are put in to match the male end on the hoop.

Items

The disclosed embodiments may include the following items:

1. A system for the rescue of a person in water, the system comprising:

a loop (830) having a distal end attached to a first end of a side strap (860);

the loop contained within a slide buckle (840);

the loop having a proximal end defining a chest strap (820);

the chest strap attached to a first end of a main body strap (870);

the main body strap having a second end attached to an attachment bar (885);

the attachment bar attached to a second end of the side strap.

2. The system of item 1 wherein the side strap comprises a first and second side strap.

3. The system of item 2 wherein a plurality of lateral tubing pieces are attached to the first and second side strap.

4. The system of item 3 wherein a sheet of material is attached to the first and second side strap.

5. The system of item 1 wherein the chest strap is attached a lower pole assembly (500), the lower poll assembly used to secure the chest strap to the person in water.

6. The system of item 5 wherein the lower pole assembly comprises a reach frame (510) with the reach frame attached to on or more strap holders (545) with the one or more strap holders releasably attached to the chest strap 820.

7. The system of item 6 wherein a buckle holder (555) is attached to the reach frame.

8. The system of item 7 herein the buckle holder retains the slide buckle.

What is claimed is:

1. A system for the rescue of a person in water, the system comprising:

a) a loop (830) having a distal end attached to a first end of a side strap (860);

b) the loop contained within a slide buckle (840);

c) the loop having a proximal end defining a chest strap (820);

d) the chest strap attached to a first end of a main body strap (870);

e) the main body strap having a second end attached to an attachment bar (885);

f) the attachment bar attached to a second end of the side strap;

g) the chest strap also attached to a lower pole assembly, the lower poll assembly used to secure the chest strap to the person in water.

2. The system of claim 1 wherein the side strap comprises a first and second side strap.

3. The system of claim 2 wherein a plurality of lateral tubing pieces are attached to the first and second side strap.

4. The system of claim 3 wherein a sheet of material is attached to the first and second side strap.

5. The system of claim 1 wherein the lower pole assembly comprises a reach frame (510) with the reach frame attached to one or more strap holders (545) with the one or more strap holders releasably attached to the chest strap.

6. The system of claim 5 wherein a buckle holder (555) is attached to the reach frame.

7. The system of claim 6 herein the buckle holder retains the slide buckle.

* * * * *